US006102259A

United States Patent [19]

Tsamourgelis et al.

[11] Patent Number: 6,102,259

[45] Date of Patent: Aug. 15, 2000

[54] PLASTIC SAFETY STOPPER

[76] Inventors: Ilias Tsamourgelis; Helen Tsamourgeli, both of 8 Kleonon Street, GR-111 42 Athens, Greece

[21] Appl. No.: 09/043,431

[22] PCT Filed: Feb. 3, 1997

[86] PCT No.: PCT/GR97/00005

§ 371 Date: Mar. 19, 1998

§ 102(e) Date: Mar. 19, 1998

[87] PCT Pub. No.: WO97/25649

PCT Pub. Date: Jul. 17, 1997

[30] Foreign Application Priority Data

Feb. 5, 1996 [GR] Greece ..... 960100040

[51] Int. Cl.[7] ..... B65D 47/00

[52] U.S. Cl. ..... 222/561; 222/511; 222/531

[58] Field of Search ..... 222/559, 517, 222/531, 511, 561, 142.8, 534, 536; 215/236, 235; 220/253, 255, 256, 345.1, 345.3, 345.4, 348, 820, 823, 824

[56] References Cited

U.S. PATENT DOCUMENTS

| | | | |
|---|---|---|---|
| D. 171,043 | 12/1953 | Moore | 222/511 |
| 1,173,503 | 2/1916 | Goetzke | 222/142.8 |
| 1,292,506 | 1/1919 | Nielsen | 222/142.8 |
| 1,553,150 | 9/1925 | Dorsey et al. | 222/142.8 |
| 1,606,593 | 11/1926 | Nenstiehl | 222/511 |
| 1,614,793 | 1/1927 | Justin | 222/142.8 |
| 1,802,359 | 4/1931 | Tone | 222/511 |
| 2,590,437 | 3/1952 | Maves | 222/142.8 |
| 2,620,098 | 12/1952 | Kinley | 222/511 |
| 3,118,577 | 1/1964 | Estabrook | 222/511 |
| 3,510,027 | 5/1970 | Fails | 222/531 |
| 3,792,803 | 2/1974 | Kessler . | |
| 3,881,643 | 5/1975 | LaVange | 222/531 X |
| 5,542,585 | 8/1996 | Peters et al. | 222/534 X |

FOREIGN PATENT DOCUMENTS

| | | |
|---|---|---|
| 0 461 060 A1 | 12/1991 | European Pat. Off. . |
| PCT/GR97/00005 | 2/1997 | European Pat. Off. . |
| 0 547 978 A1 | 6/1993 | France . |
| WO 86/01700 | 3/1986 | WIPO . |

*Primary Examiner*—Joseph A. Kaufman
*Assistant Examiner*—Thach Bui
*Attorney, Agent, or Firm*—Herbert Dubno

[57] ABSTRACT

A safety closure has a plastic cap which is formed unitarily with a pair of elastic arms and a pressing plate which operates a mechanism directly on the cap to block and unblock the flow of a substance from the container. The mechanism may include a pivotable spout or simply arrangements in which an opening in the slider is aligned with the opening in the cap.

7 Claims, 8 Drawing Sheets

PLASTIC SAFETY STOPPER

This invention refers to a plastic safety stopper used for the sealing of glass, plastic or carton bottles or various other types of containers. Its outflow opening, does not open immediately and it can remain open only for as long as it is desirable. If not used, the product stays firmly closed since the outflow opening is covered by a self returning slide cover in its original position without the need of a special move from the user. The head of the stopper with its operation mechanism and the slide cover is a single inseparable compact unit.

There are many types of stoppers, lids and caps available in the market for a vast array of applications, most if not all of them are known to allow for easy opening of the container they are meant to close and to further remain in the "open" position. It remains in the open position until it is manually closed by the user.

The Intoxication Ailments Clinic at the "Aglaea Kyriakou" Children's Hospital in Athens has published a revealing report on the number of intoxication cases. This is increasingly due to the tragic defects that such regular types of bottle stoppers have been found to present. More specifically, in the year activities report of this Hospital for year 1993 published in Athens in 1994, it was mentioned that the emergency service had, over 1993, received as many as 30.635 calls for intoxication's, 10.715 of which involved minors between the age of 2–4. Many of them had opened such stoppers of containers having medicine or domestic use products (i.e. detergents, cosmetics etc.) Home has been quoted as one of the most common areas where intoxication occurs (26.201 cases, 85.5%) such an unbelievable high rate of cases treated at the clinic solely and exclusively represented intoxication cases (other types of cases such as burns etc. are not included in the figures quoted above)

According to this invention the stopper can only open by persons who have the skill to do so and not by children. An other advantage of this invention is that the safety stopper can remain open only for as long as the contents are required to flow and it returns to the "close" position automatically. The head of the stopper with its operation mechanism and the slide cover is a single inseparable compact unit.

Set fourth below is a description of a particular application of the invention available, appropriately referenced with a series of figures meant to explain the way in which such idea may be materialized.

Figure 1:
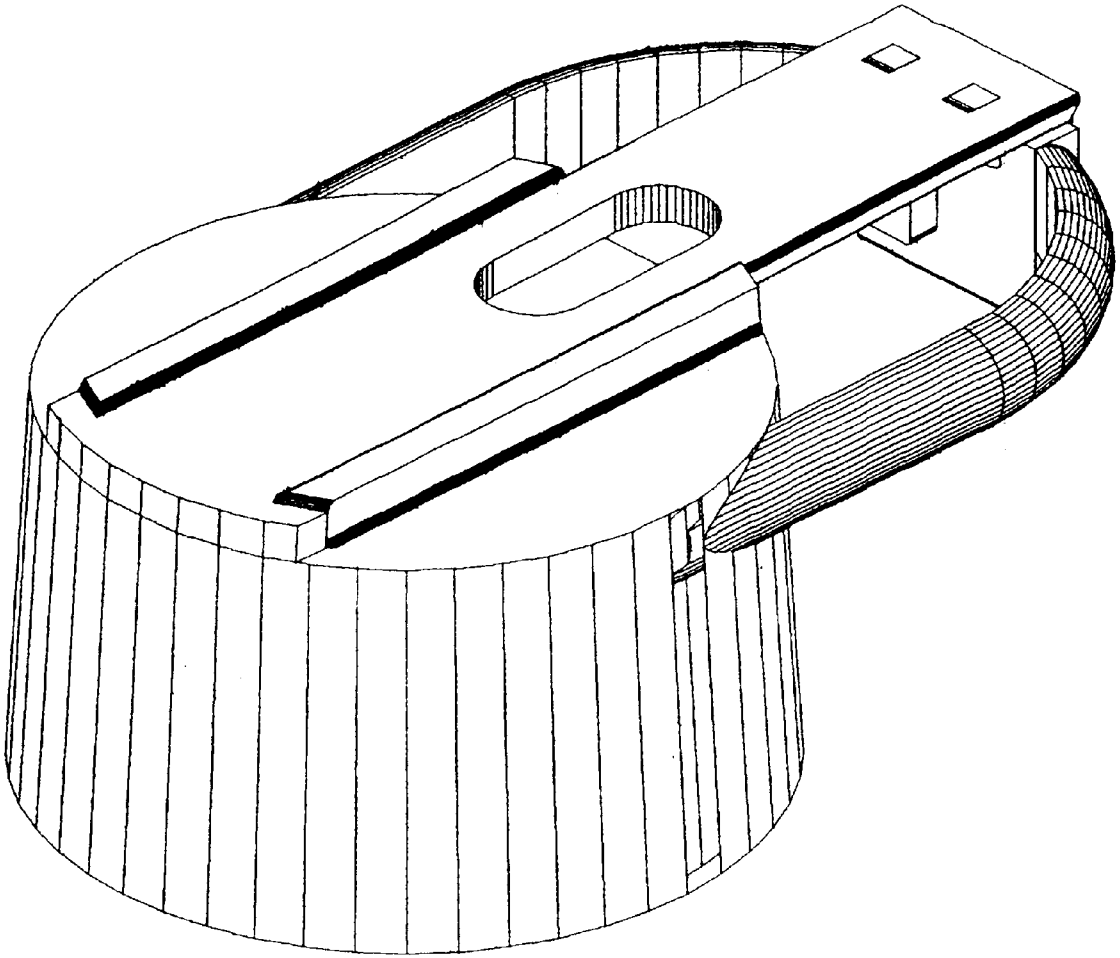
Figure 2:
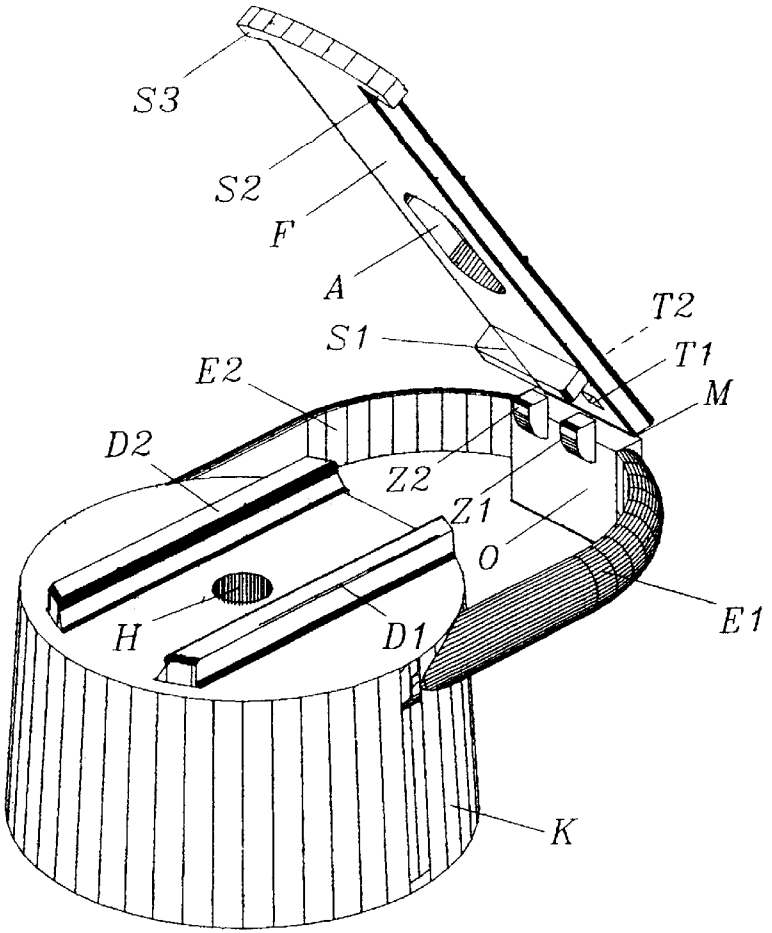

"FIG. 1" shows a plan of the plastic safety stopper according to the invention "FIG. 2" provides the same aspect as the one shown in "FIG. 1" although the slide cover of the stopper it is not into the function position.

The safe stopper shown on these figures applies to closed bottles, containers, etc. Size and shape may vary according to the parameters of the application required. The stopper consists of a head (K) with an out flow opening (H) its size and shape is in proportion with the out flow rate and supply, even in case the contents is pharmaceuticals.

From head (K) are extended two arms (E1) and (E2) both of which are connected to presser (O). In its turn, the presser is connected to slide cover (F) with a membrane (M). The slide cover (F) rotating around the membrane (M) fastens into the guides (D1) and (D2). At the same time the grooves (T1) and (T2) of the slide cover (F) fit to the projections (Z1) and (Z2) of the presser (O) so the slide cover (F) seals the outflow opening (H).

More specifically as far as the slide cover is concerned, groove (A) and projection (S1) have been arranged in such a way as to allow the slide cover to slide along guides (D1) and (D2) as soon as pressure is exercised upon the presser (O), eventually reaching a position where projection (S1) becomes adjacent to the head (K) while groove (A) is simultaneously positioned above the out flow opening (H) of the stopper. In this way, the opening is fully uncovered allowing the outflow of the contains of the bottle, container etc.

Outflow of the contains of the containers through the outflow opening (H) is obtained by pressing the presser (O) and only when groove (A) starts unlocking opening (H). Maximum flow rate is obtained from the moment groove (A) is brought the outflow opening (H).

The distance that the slide cover (F) covers until it reaches the position to allow the contains to come out is a safety course the length of which shall be determined on an individual basis, depending on how dangerous the content of the bottle, container, etc. is.

Arms (E1) and (E2) elasticity distorted by the pressure exercised upon the presser (O) tend to restore the slide cover (F) in its original position and seal the opening (H) of the lid, which is what eventually happens as soon as pressure is no more exercised to the presser (O).

Projections (S2) and (S3) of the slide cover (F) are meant to determine its terminal position of the latter when it moves backwards subject to the effect of arms (E1) and (E2). The head of the stopper (K) with the operation mechanism (E1,E2,O) and the slide cover (F) is a single inseparable compact unit.

A second application of the invention, with references to figures explaining its materialization, is described below.

Figure 3:
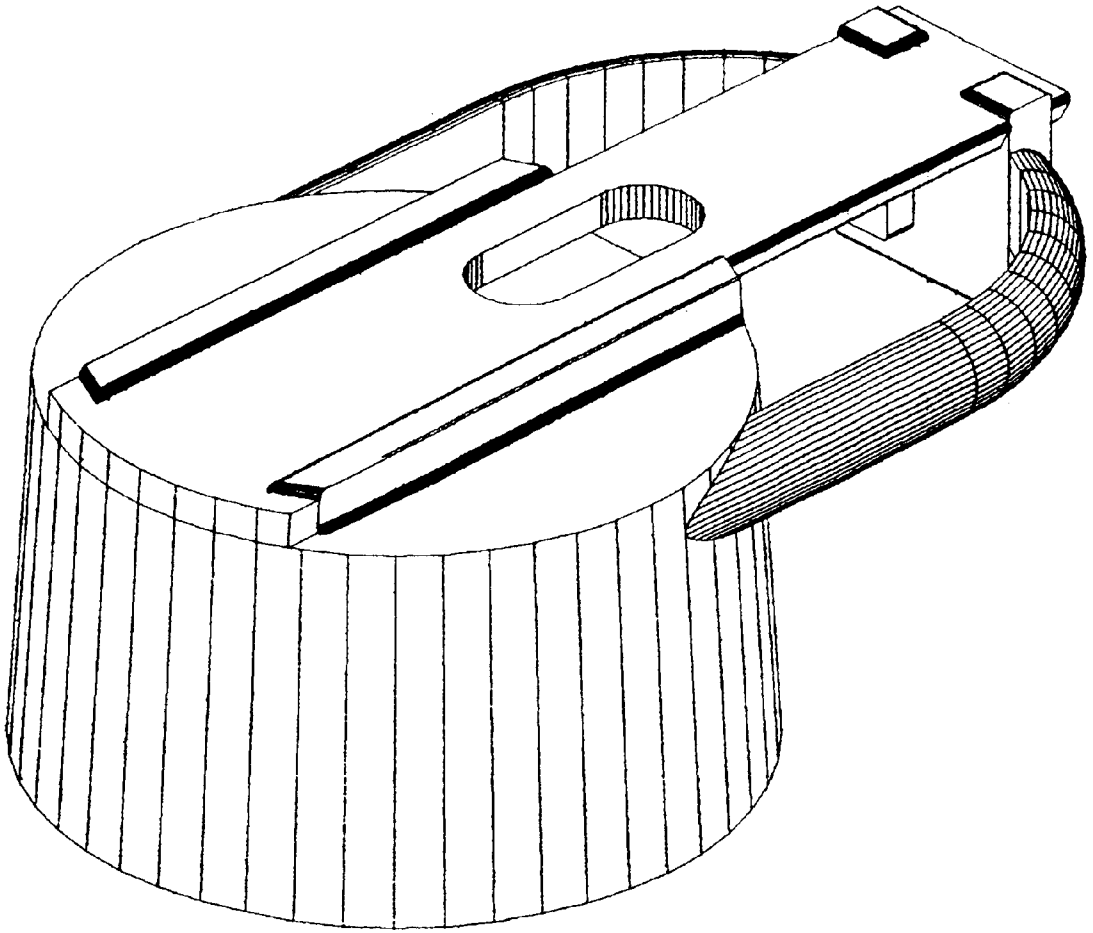

"FIG. 3" shows a plan of the plastic safety stopper.

Figure 4:
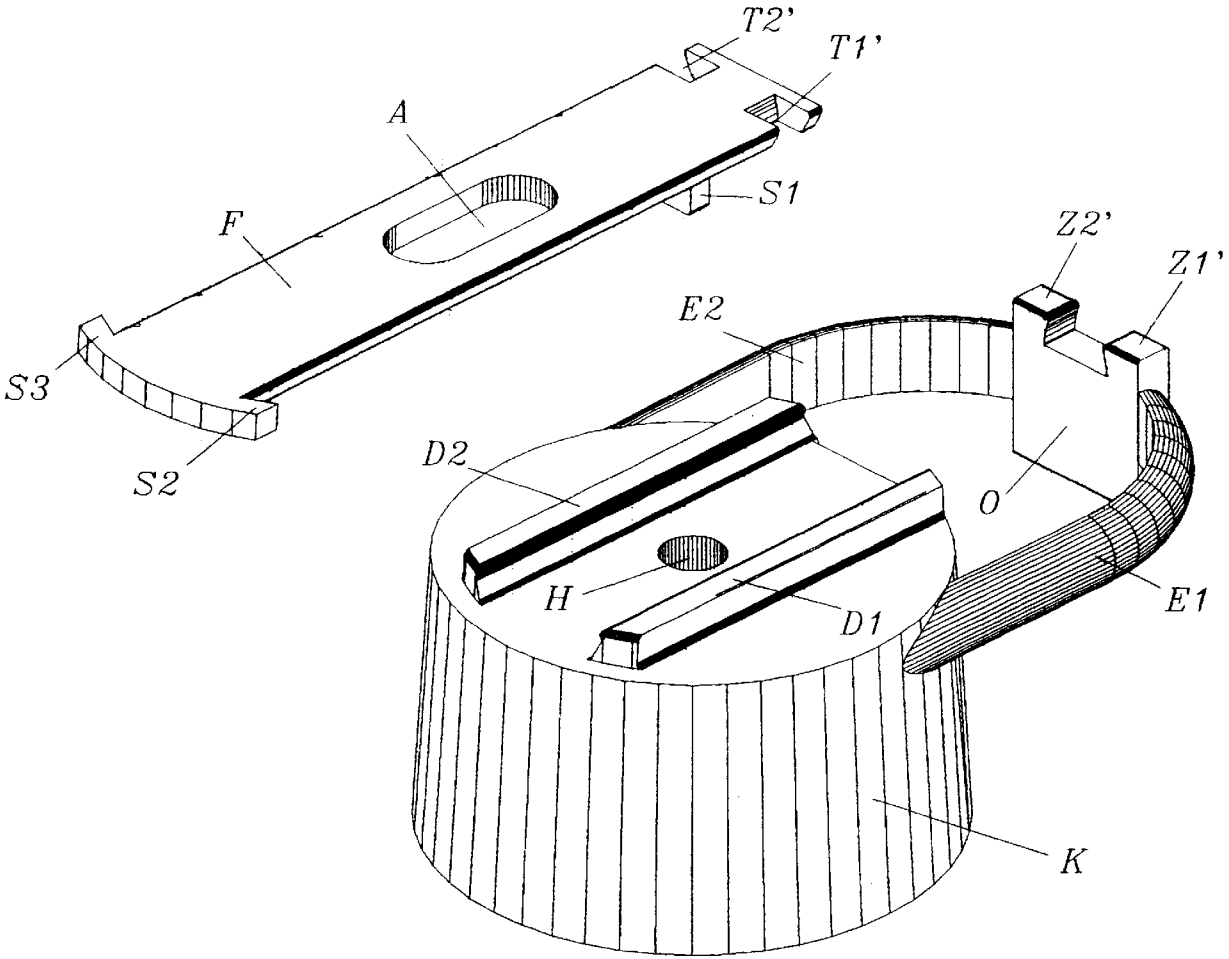

"FIG. 4" provides the same aspect as the one shown in FIG. 3 although the slide cover is not into the function position.

The safety stopper shown on those figures has the slide cover (F) separated from the rest part of the unit with grooves (T1') and (T2') fitted and fastened to projections (Z1') and (Z2') of the presser (O). The slide cover has been arranged in such a way as to slide along guides (D1) and (D2) covering adjacently the outflow opening (H).

A third application based upon the same invention with references to figures is described below.

Figure 5:
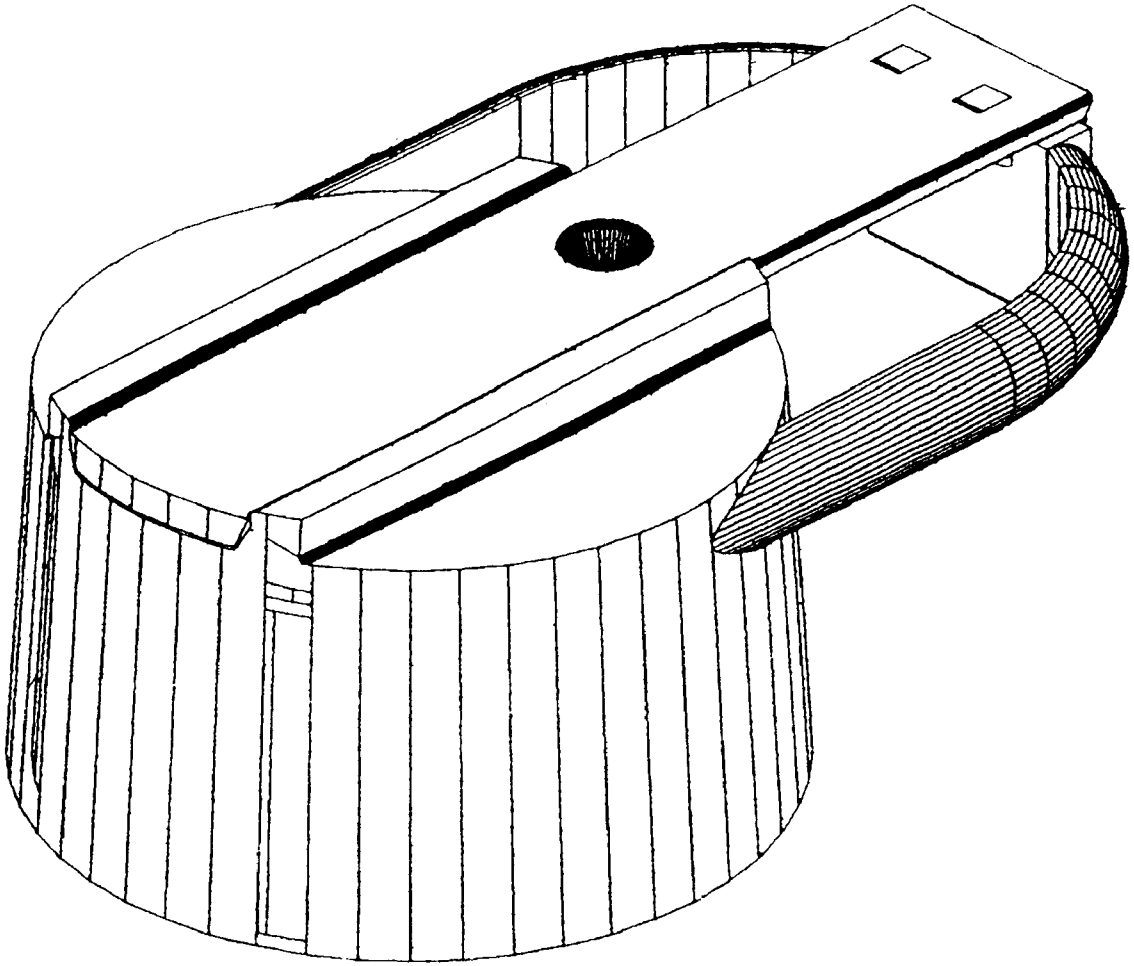

"FIG. 5" shows a plan of the plastic safety stopper according to the invention.

Figure 6:
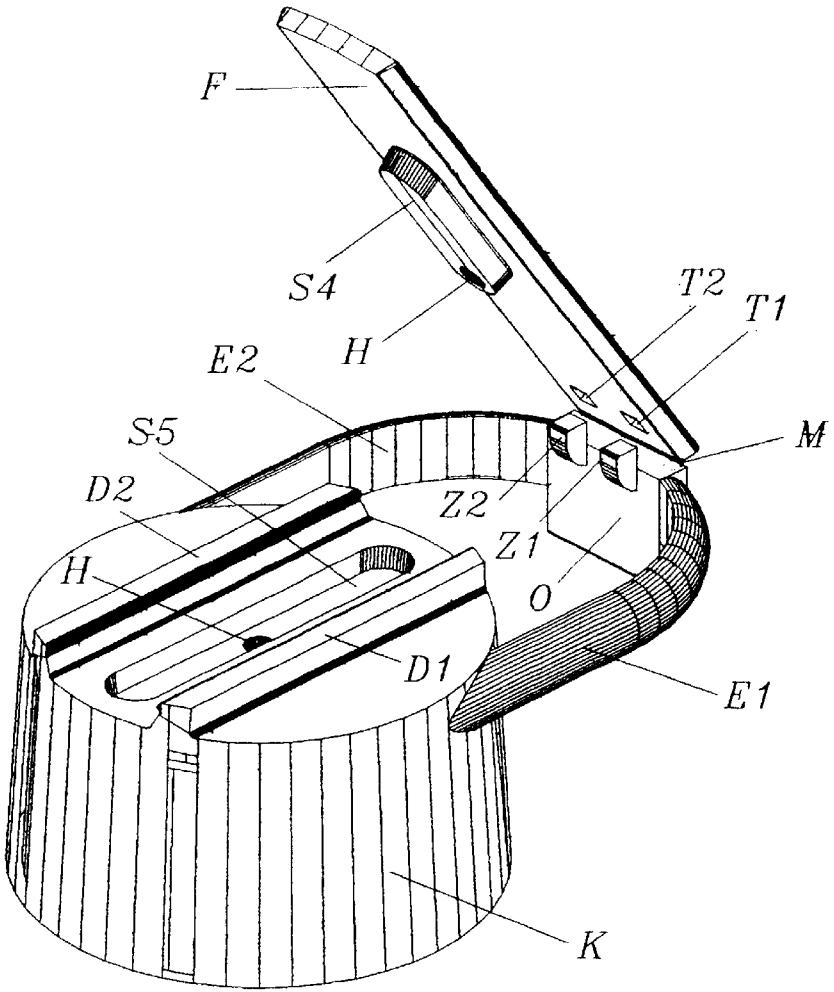

"FIG. 6" shows the same aspect of FIG. 5 although the slide cover is not into the function position.

The figure shows a safety stopper where a projection (S4) on the slide cover (F) has been interconnected with a cavity (S5) in the head (K) of the stopper. Thus, each time the slide cover (F) slides along guides (D1) and (D2) the projection (S4) covering the outflow opening (H) gliding along through cavity (S5) defining the limits of slide cover's course.

A fourth application based upon the same invention with references to figures described below.

Figure 7:
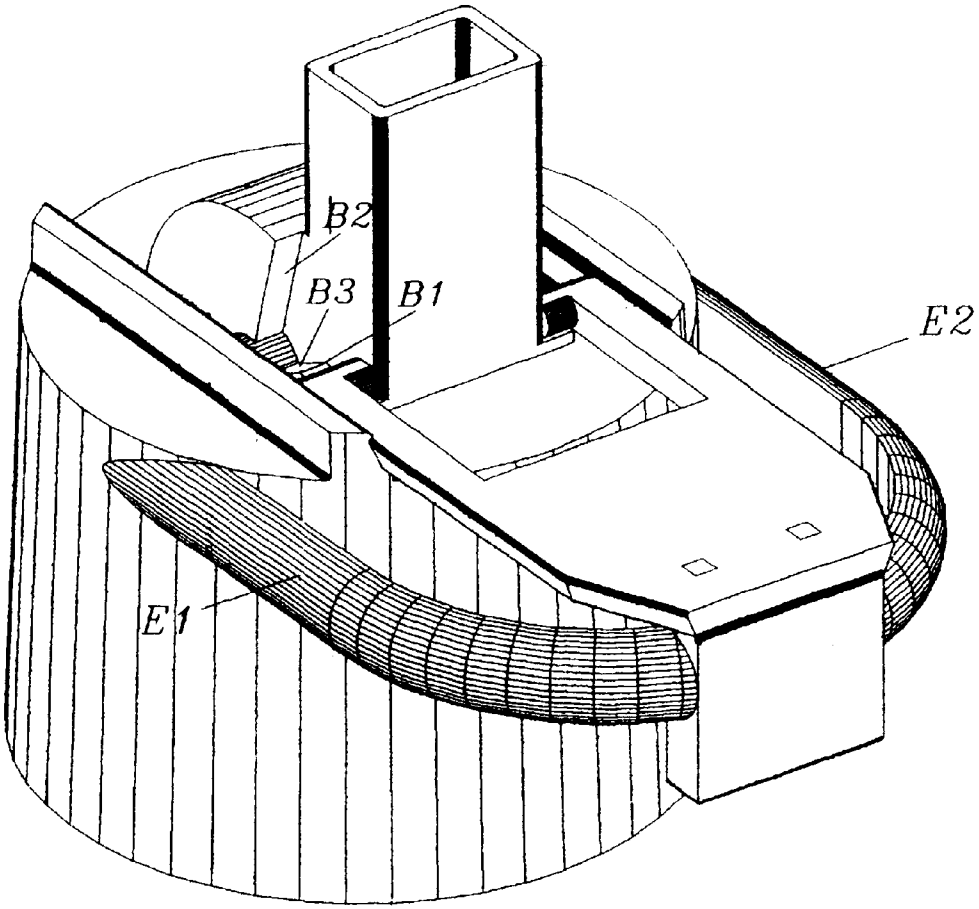

"FIG. 7" shows a plan of the plastic safety stopper according to the invention.

Figure 8:
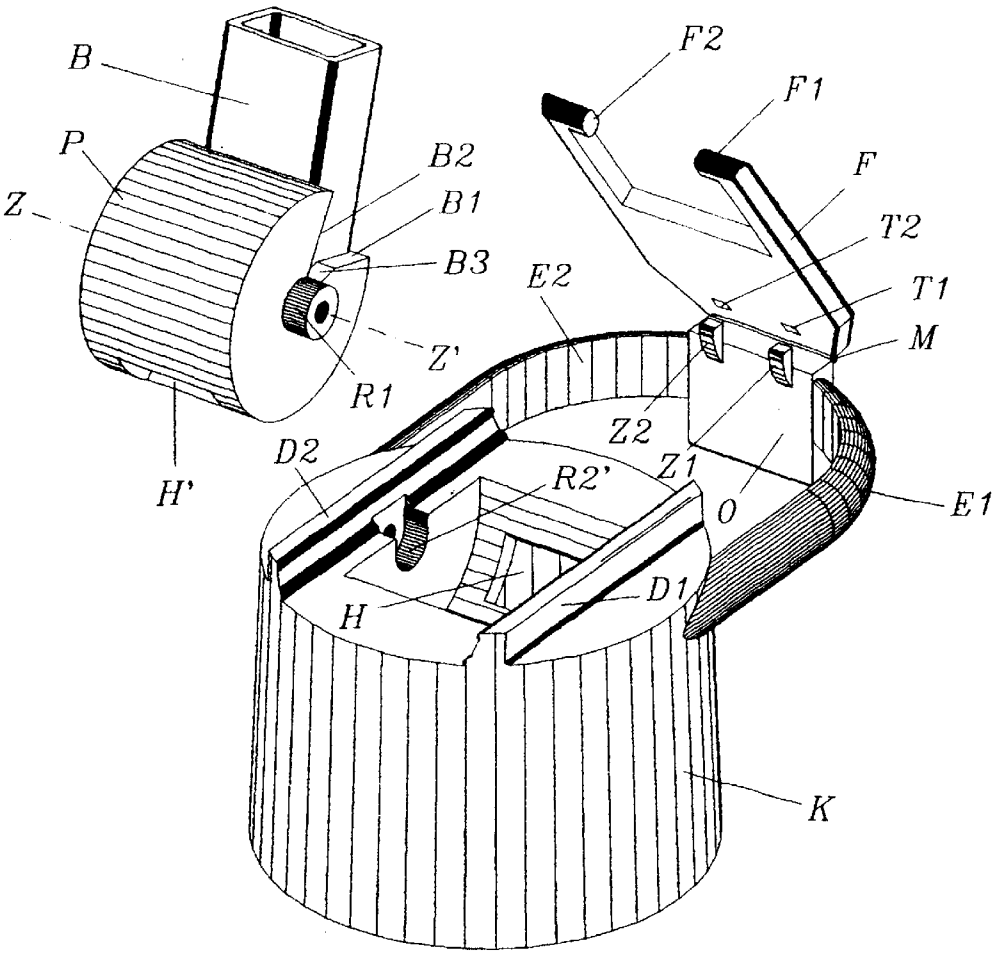

"FIG. 8" shows another aspect of the safety stopper different from the one shown on FIG. 7, the slide cover is not in its functional position and movable nozzle has been arranged at a distance from the head.

Figures show a safety stopper consisting of a head (K) upon which a cavity has been arranged allowing appropriate fitting of the movable nozzle (B) with outflow opening (H).

Arranged on the movable nozzle (B) there is a two-side hole (H') starting from the drum (P) and going all the way up to the upper part. The size and shape of such hole (H') is proportionate to the flow and dispense rate. It is relatively proportionate to the size and shape of opening (H).

Cylinders (R1) and (R2) of movable nozzle (B) are made to fasten into cylindrical grooves (R1') and (R2') of head (K) resulting that the nozzle (B) rotates around the axis (ZZ') which passes through their center whilst the drum (P) comes to fasten into the corresponding grooves upon head (K) in such a way as to allow the hollow part of the drum (P) to adjacently fit into the cavity of head (K), the outflow opening (H) in the head (K) of the stopper is covered by the drum (P).

The rotation of movable nozzle (B) occurs when pressure is exercised upon the presser (O) which has been connected to the slide cover (F) which slides along the guides (D1) and (D2). As the slide cover (F) slides on, its projection (F1) and (F2) meet and eventually push forward the surfaces (B2) of the movable nozzle (B). This way, the movable nozzle (B) is forced to rotate around axis (ZZ').

Once such rotation has started and the movable nozzle is brought up to certain angle, then the outflow opening (H) of the head (K) is disengaged from opening (H') allowing the contents of the container to outflow. Maximum flow rates are obtained as soon as outflow opening (H') is brought over opening (H). This happens when the projecting part of the drum (P) upon the movable nozzle (B) which has already been rotated becomes adjacent to the surface of the head (K).

While the pressure is exercised upon the presser (O), arms (E1), (E2) are elasticity distorted tending to bring the slide cover (F) back to its original position. The back sides of projections (F1) and (F2) touching and pushing surfaces (B3) set the nozzle (B) to turn around the (ZZ') axis although to an adverse course so that the drum (P) is brought to cover the outflow opening (H) of the head (K) of the stopper.

On its part the movable nozzle (B) is brought back to its original position which may be the one in which the rear part of the projection of drum (P) upon nozzle (B) touches the surface of head (K).

With nozzle (B) in such a position, the slide cover may continue to move backwards on an additional safety course further to the one normally made by the slide cover until opening (H) meets opening (H'). In such case projections (F1) and (F2) slide upon surface (B1) of drum (P) of nozzle (B) in such away as to obtain due sealing since under the circumstances, the only way possible for nozzle (B) to turn is to exercise pressure upon the presser (O).

Surfaces (B1), (B2) and (B3) upon the drum (P) of movable nozzle (B) are identical both on the right and on the left side, because of the symmetry of the movable nozzle to its axis which is vertical to (ZZ') passes through its center.

What is claimed is:

1. A safety closure for dispensing a substance from a container, said safety closure comprising:

a plastic cap fittable to said container and having an opening through which said substance can be dispensed, a pair of elastic arms projecting laterally from said cap and unitary therewith, and a pressing plate connected to said arms;

a closure mechanism on said cap, actuatable by said pressing plate to unblock said opening and enable discharge of said substance, and automatically reclosed upon release of said pressing plate by elasticity of said arms, said closure mechanism including:

a pair of mutually parallel guides on said cap, and a slider engaged in said guides, connected to said pressing plate and linearly shiftable by said pressing plate against elastic force of said arms to unblock said opening.

2. The safety closure defined in claim 1 wherein said, slider is formed directly with an opening alignable with said opening in said cap for unblocking thereof.

3. The safety closure defined in claim 2, further comprising a membrane hinge between said plate and said slider.

4. The safety closure defined in claim 2, further comprising stops on said slider limiting sliding displacement of said slider in said guides.

5. The safety closure defined in claim 1 wherein said plate has a notch receiving said slider and projections engageable in notches in said slider.

6. The safety closure defined in claim 1 wherein said cap is formed with an elongated recess parallel to said guides and said slider is formed with an elongated projection receivable in said recess and slidable between limits therein.

7. The safety closure defined in claim 1 wherein said closure mechanism includes a spout pivotal on said cap and engaged by said slider for swinging movement of said spout to unblock and close said opening, said spout having a passage communicating with said opening in the unblocked position.

* * * * *